US009831052B2

(12) United States Patent
Kurobe

(10) Patent No.: US 9,831,052 B2
(45) Date of Patent: Nov. 28, 2017

(54) KEYBOARD

(71) Applicant: FANUC Corporation, Yamanashi (JP)

(72) Inventor: Yoshiaki Kurobe, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 15/000,390

(22) Filed: Jan. 19, 2016

(65) Prior Publication Data

US 2016/0217947 A1 Jul. 28, 2016

(30) Foreign Application Priority Data

Jan. 23, 2015 (JP) ..... 2015-011072

(51) Int. Cl.
*H01H 13/70* (2006.01)
*H01H 13/86* (2006.01)
*H01H 13/06* (2006.01)

(52) U.S. Cl.
CPC ..... *H01H 13/86* (2013.01); *H01H 13/06* (2013.01); *H01H 2223/036* (2013.01)

(58) Field of Classification Search
CPC .. H01H 13/06; H01H 13/86; H01H 2223/036; H01H 3/12; H01H 13/50; H01H 13/70; H01H 13/7006; H01H 2003/12
USPC .... 200/345, 333, 341, 318.1, 293, 294, 296, 200/5 A
See application file for complete search history.

(56) References Cited

U.S. PATENT DOCUMENTS 3,952,174 A 4/1976 Boulanger et al.
4,408,103 A * 10/1983 Smith, III ..... G05G 9/04785 200/17 R
5,481,074 A * 1/1996 English ..... H01H 13/705 200/343
5,834,715 A * 11/1998 Sato ..... H01H 13/70 200/302.1
6,329,614 B1 * 12/2001 Miyashita ..... H01H 25/041 200/5 R
6,437,267 B1 * 8/2002 Imai ..... H01H 13/702 200/302.1

(Continued)

FOREIGN PATENT DOCUMENTS

DE 102008040868 A1 2/2010
EP 1152443 A2 11/2001

(Continued)

OTHER PUBLICATIONS

Decision to Grant a Patent in JP Patent Application No. 2015-011072, mailed Nov. 22, 2016.

(Continued)

*Primary Examiner* — Anthony R. Jimenez
(74) *Attorney, Agent, or Firm* — Hauptman Ham, LLP

(57) ABSTRACT

A vertical keyboard, which is used with key top pressing direction set to a substantially horizontal direction, includes a housing having opening portions into which the key tops are fitted. A lower internal surface of the opening portion is inclined with respect to a direction perpendicular to the surface of the housing, in a downward direction from the keyboard interior toward the keyboard surface side. This can reduce adhesion or accumulation of dust or dirt in a space between the lower internal surface of the opening portion and the lower internal surface of the key top.

5 Claims, 4 Drawing Sheets

(56) References Cited

U.S. PATENT DOCUMENTS

2001/0048379 A1 12/2001 Kaikuranta et al.

FOREIGN PATENT DOCUMENTS

| | | | |
|---|---|---|---|
| JP | H02-70322 | U | 5/1990 |
| JP | H05-343859 | A | 12/1993 |
| JP | 10-301688 | A | 11/1998 |
| JP | 2007-79835 | A | 3/2007 |
| JP | 2010-117937 | A | 5/2010 |

OTHER PUBLICATIONS

Office Action in DE Patent Application No. 102016100612.2, dated Jul. 19, 2017.

* cited by examiner

KEYBOARD

RELATED APPLICATIONS

The present application claims priority to Japanese Application Number 2015-011072, filed Jan. 23, 2015, the disclosure of which is hereby incorporated by reference herein in its entirety.

BACKGROUND OF THE INVENTION

1. Field of the Invention

The present invention relates to keyboards to be used for electronic devices, for example, numerical controllers for controlling machine tools.

2. Description of the Related Art

FIG. 6 is a schematic cross-sectional view depicting a conventional keyboard. A keyboard mounted on an electronic device is subjected to airborne dust around the keyboard, a mist of oil such as a cutting lubricant, and dirt on the hands of an operator during the use. Such dust, oil mist, and dirt inevitably enter spaces around opening portions of the housing for mounting keys of the keyboard, and adhere to the opening portions of the housing as foreign matter. Such foreign matter may affect operability of the keys.

FIG. 5 illustrates a vertical keyboard. The keyboard is used as a means of entering data into a numerical controller for controlling a machine tool.

A control panel 1 of the numerical controller includes a display device 2 and a vertical keyboard 3. The vertical keyboard 3 is used in a position along the vertical direction of the keyboard. In this structure, the foreign matter such as dust tends to adhere or accumulate between a lower internal surface of a key top 4 and a lower internal surface of an opening portion in the housing (see FIG. 6). When the control panel 1 is used in a state where it stands erect, a first space 5 exists between an upper surface of an opening portion in a housing 7 and an upper surface of the key top 4, and a second space 6 exists between a lower internal surface of an opening portion in the housing 7 and a lower internal surface of the key top 4. The key top 4 moves in the first space 5, thereby preventing dust and dirt from adhering or accumulating onto the upper surface of the key top 4. In the second space 6, on the other hand, dust and dirt easily adhere or accumulate onto the side surface of the lower side of the opening portion. Such accumulated dust and dirt moves from a keyboard exterior 8 side to a keyboard interior 9 side over time, and eventually enter the keyboard interior 9.

To solve such a problem, Japanese Utility Model Application Laid-Open No. 02-070322 discloses a technique for making dust prevention sheet openings on a keyboard surface and an outer periphery of a key come in contact with each other to seal the openings when no key is pressed. Japanese Utility Model Application Laid-Open No. 05-343859 discloses a technique in which a dust prevention sheet is accommodated in a housing of a keyboard and when the keyboard is not used, the dust prevention sheet is pulled out of the housing to cover keys.

The above-described prior art techniques seal the spaces by making the openings of the housing and the outer peripheries of the keys mounted in the openings come in contact with each other, or covering the keyboard surface with cloth to prevent dust and dirt from entering the interior of the keyboard.

Unfortunately, the method of making the housing openings and the key outer peripheries come in contact with each other may enhance the adhesion of the housing openings and keys due to the foreign matter, which is, for example, sticky dirt. The method of covering the surface of the keyboard with the cloth cannot be applied during the use of the keyboard and requires the additional preparation of the cloth, increasing the cost.

SUMMARY OF THE INVENTION

An object of the present invention, which has been made to solve the above-described problems in the conventional techniques, is to provide a keyboard that has housing opening portions designed to reduce the adhesion or accumulation of foreign matter such as dust and dirt in spaces between lower internal surfaces of keys and lower internal surfaces of the housing opening portions.

A keyboard according to the present invention includes a mounting plate for fixing key switches, key tops attached to sliding portions of the key switches fixed to the mounting plate, and a housing having opening portions into which the key tops are fitted. When the keyboard is used in a state where a press direction of the key top is set to be a horizontal direction or a downwardly inclined direction having an angle of $\alpha$ degrees ($0° \leq \alpha \leq 90°$) with respect to the horizontal direction, at least a portion of a lower internal surface of the opening portion of the housing, which connects with the surface of the housing, is inclined at an angle of $\beta$ degrees ($0° < \beta < 90°$) with respect to the horizontal direction in a downward direction from the interior to exterior of the keyboard.

The lower internal surface of the opening portion may have a vertical section of an elliptic arc shape.

According to the present invention, with housing openings designed to reduce dust adhesion or accumulation, keyboards that can reduce adhesion or accumulation of foreign matter such as dust or dirt in a space between a key lower internal surface and a housing opening lower internal surface can be provided.

BRIEF DESCRIPTION OF THE DRAWINGS

The forgoing and other objects and feature of the invention will be apparent from the following description of preferred embodiments of the invention with reference to the accompanying drawings, in which.

DETAILED DESCRIPTION OF THE PREFERRED EMBODIMENTS

Figure 1:
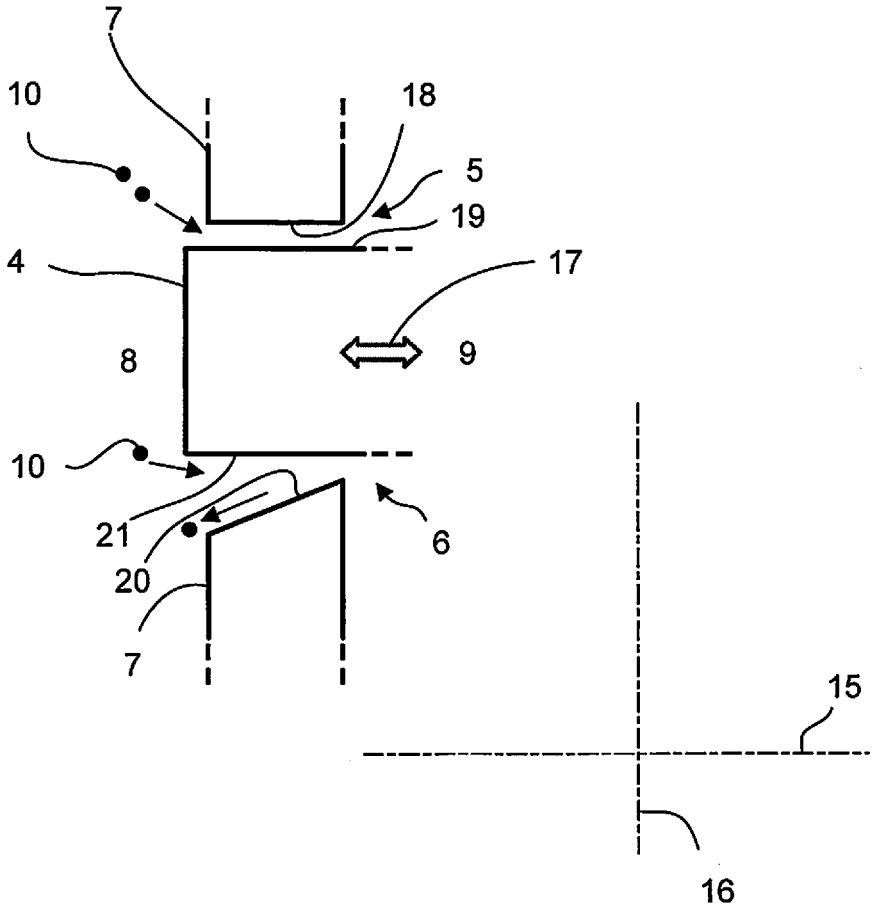
FIG. 1 is a schematic cross-sectional view of a part including a key top in a keyboard according to a first embodiment of the present invention.

Hereinafter, embodiments of the present invention will be described with reference to the attached drawings. The same reference numerals as those in the known art are used to components the same as or similar to the known art.

Figure 5:
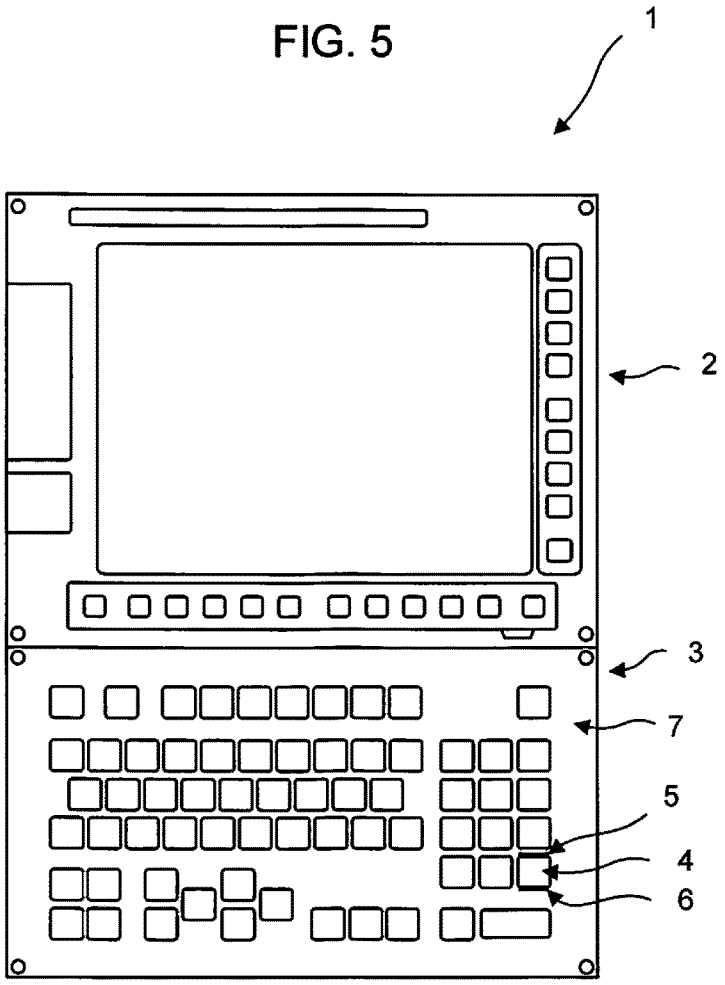
FIG. 5 illustrates a vertical keyboard.
Figure 6:
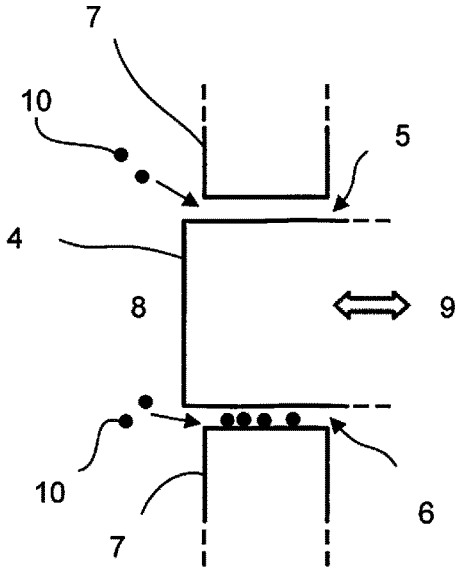
FIG. 6 is a schematic cross-sectional view of a part including a key top in a conventional keyboard.

A basic structure of the control panel 1 into which a keyboard according to an embodiment of the present invention is fitted is similar to that illustrated in FIG. 5. As illustrated in FIG. 5, a keyboard according to an embodiment of the present invention is a vertical keyboard 3 provided with a housing 7 having opening portions into which key tops 4 are to be fitted.

Figure 2:
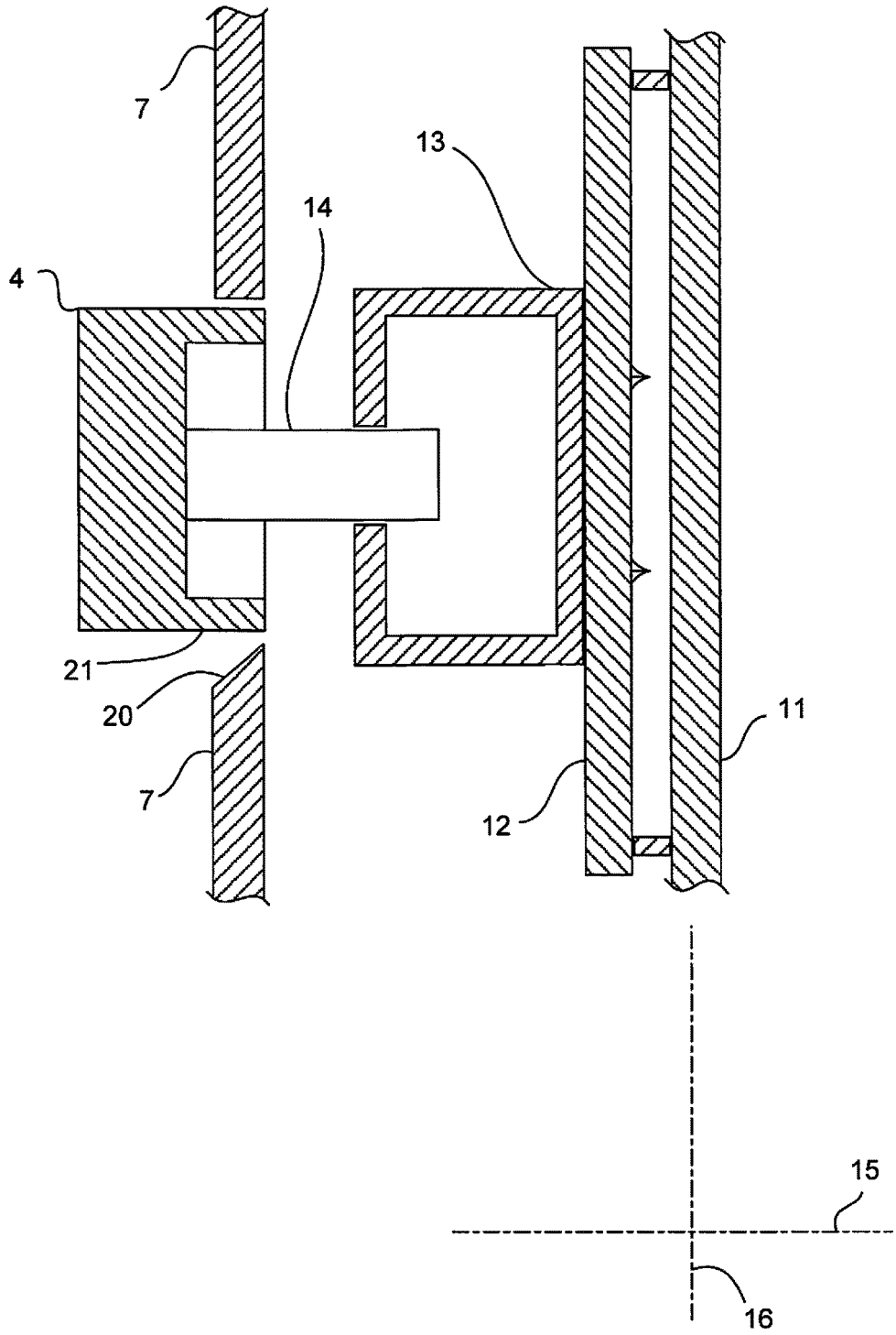
FIG. 2 illustrates the part including the key top illustrated in FIG. 1 in detail.

With reference to FIG. 1 and FIG. 2, the keyboard (vertical keyboard) according to a first embodiment of the present invention is described.

The keyboard includes the housing 7, a mounting plate 11, a sliding portion (plunger) 14, and the key top 4. The mounting plate 11 is used to fix a key switch 13 through a printed board 12. The sliding portion 14 is a plunger for the key switch 13. The key top 4 is fixed to the sliding portion 14. The printed board 12 has wiring for connection to the key switch 13. A cross section of the key top 4 parallel to a keyboard surface 8 has a quadrilateral shape. The mounting plate 11 is fixed to the housing 7 with a fixing means, for example, a screw (not illustrated). The housing 7 is provided with the opening portions into which the key tops 4 are to be fitted. An operator pushes the key top 4 in a press direction 17 to move the key top 4 in a keyboard interior 9 direction. When the operator releases his/her finger, the key top 4 moves toward a keyboard surface 8 with the help of an elastic member (not illustrated).

The opening portions in the housing 7 are described. As illustrated in FIG. 1, a first space 5 exists between an upper surface 18 of the opening portion of the housing 7 and an upper surface 19 of the key top 4. A second space 6 exists between a lower internal surface 20 of the opening portion of the housing 7 and a lower internal surface 21 of the key top 4.

The keyboard illustrated in FIG. 1 and FIG. 2 is the vertical keyboard 3. The keyboard 3 includes the mounting plate 11 for fixing the key switch 13, the key top 4 attached to the sliding portion of the key switch 13, which has been fixed to the mounting plate 11, and the housing 7 having the opening portion corresponding to the cross-sectional shape of the key top 4 so that the key top 4 fits into the opening portion. When the vertical keyboard 3 is used in a state where the press direction 17 of the key top 4 is substantially horizontal direction, as illustrated in FIG. 1, the upper surface 18 of the opening portion of the housing 7 is substantially perpendicular to the surface of the housing 7, whereas the lower internal surface 20 of the opening portion of the housing 7 is inclined with respect to the direction perpendicular to the surface of the housing 7 in the downward direction from the keyboard interior 9 toward the keyboard surface 8.

The inclination of the lower internal surface 20 of the opening portion of the housing 7 with respect to the direction perpendicular to the surface of the housing 7 in the downward direction from the keyboard interior 9 toward the keyboard surface 8 allows dust and dirt (dust 10) to be drawn by gravity toward the keyboard surface 8 side. This can reduce adhesion or accumulation of the dust and dirt (dust 10) in the second space 6 between the lower internal surface 21 of the key top 4 and the lower internal surface 20 of the opening portion of the housing 7.

Figure 3:
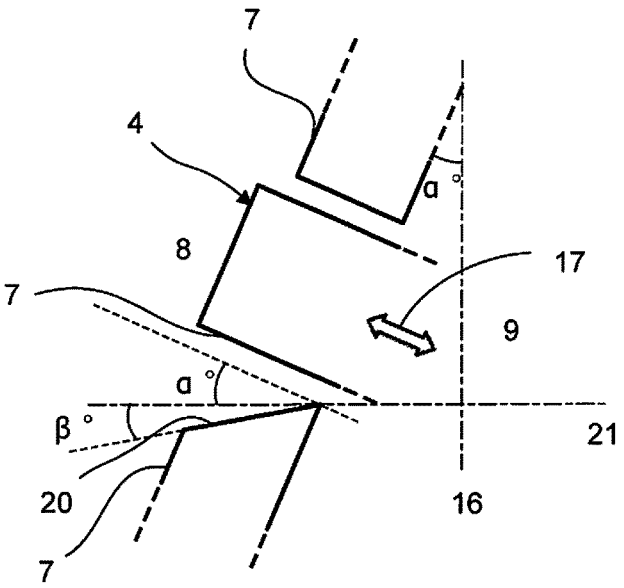
FIG. 3 is a schematic cross-sectional view of a part including a key top in a keyboard according to a second embodiment of the present invention.

With reference to FIG. 3, a keyboard (vertical keyboard) according to a second embodiment of the present invention is described.

The vertical keyboard 3 is inclined an angle of $\alpha$ degrees ($0° \leq \alpha \leq 90°$) with respect to the vertical direction, and then, the lower internal surface 20 of the opening portion of the housing 7 is inclined an angle of $\beta$ degrees ($0° < \beta < 90°$) with respect to the horizontal direction. That is, when the vertical keyboard 3 is used in the inclined state, the lower internal surface 20 of the opening portion of the housing 7 is inclined in the downward direction toward the keyboard surface 8 side.

The lower internal surface 20 of the opening portion of the housing 7 is inclined in the downward direction toward the keyboard surface 8 side. The inclination $\beta$ of the lower internal surface 20 in the opening portion of the housing 7 allows the dust and dirt (dust 10) to be drawn by gravity toward the keyboard surface 8 side. This can reduce adhesion or accumulation of the dust and dirt (dust 10) in the second space 6 between the lower internal surface 21 of the key top 4 and the lower internal surface 20 of the opening portion of the housing 7.

Figure 4:
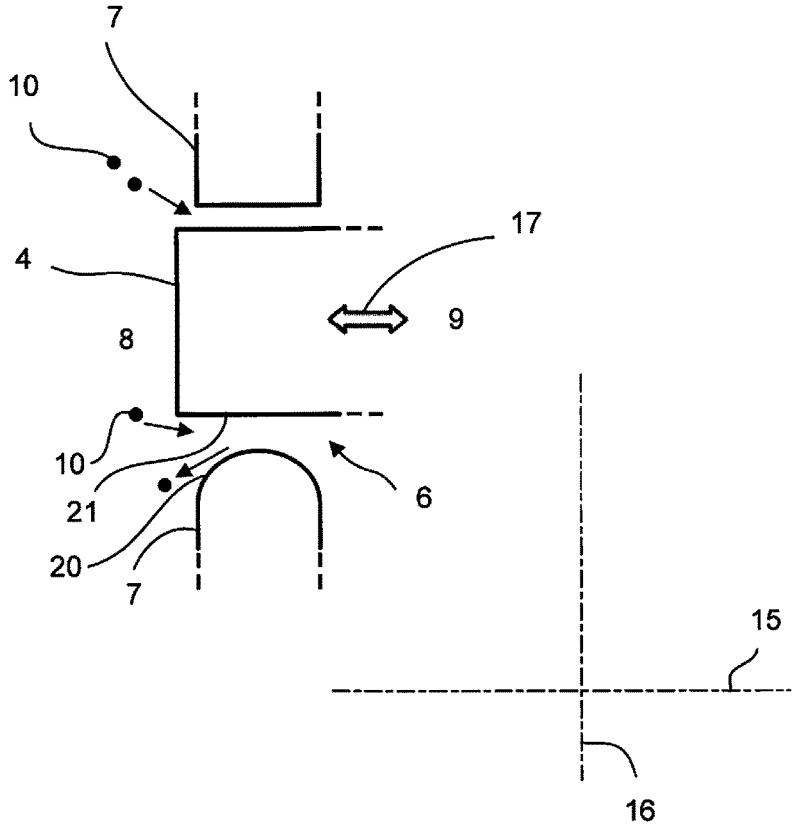
FIG. 4 is a schematic cross-sectional view of a part including a key top in a keyboard according to a third embodiment of the present invention.

With reference to FIG. 4, a keyboard (vertical keyboard) according to a third embodiment of the present invention is described.

As illustrated in FIG. 4, in the keyboard according to the embodiment, the lower internal surface 20 of the opening portion of the housing 7 has a vertical cross section of an elliptic arc shape. In the lower internal surface 20 of the opening portion of the housing 7, at least front portion connecting with the surface of the housing 7 viewed from the keyboard surface 8 is inclined at an angle of $\beta$ degrees ($0° < \beta < 90°$) with respect to the horizontal direction in a downward direction from the interior to exterior of the vertical keyboard 3.

The elliptic arc shape of the cross section of the lower internal surface 20 of the opening portion of the housing 7 allows the dust and dirt (dust 10) to be drawn by gravity toward the keyboard surface 8 side. This can reduce adhesion or accumulation of the dust and dirt (dust 10) in the second space 6 between the lower internal surface 21 of the key top 4 and the lower internal surface 20 of the opening portion of the housing 7.

The cross-sectional shape of the key top 4 on a plane parallel to the keyboard surface 8 may be a triangle, a quadrangle, or an ellipse. In a case of the key top 4 having a triangular cross section, the lower internal surface 20 of the opening portion of the housing 7 opposite to the base of the triangle has a structure similar to that in the above-described embodiments. In a case of the key top 4 having an elliptic cross section, the lower internal surface 20 of the opening portion of the housing 7 opposite to a part lower than the center line of the elliptic shape has a structure similar to that in the above-described embodiments.

The invention claimed is:

1. A vertical keyboard installed in a position along a direction of gravity, the keyboard comprising:

a mounting plate for fixing key switches, the mounting plate being disposed along a plane extending in the direction of gravity;

key tops attached to sliding portions of the key switches fixed to the mounting plate; and a housing having an outer surface with opening portions into which the key tops are fitted, wherein, when the keyboard is installed in a state where a press direction of each of the key tops is a downwardly inclined direction having an angle of $\alpha$ degrees ($0° < \alpha < 90°$) with respect to a horizontal direction, a lower internal surface of each of the opening portions of the housing has at least a portion which connects with the outer surface of the housing and which is inclined downwardly at an angle of $\beta$ degrees ($0° < \beta < 90°$) with respect to the horizontal direction from an interior to an exterior of the keyboard, wherein the keyboard is installed and kept along the direction of gravity, which is a vertical direction of the keyboard while the keyboard is in use, for entering data into a numerical controller for controlling a machine tool, and the keyboard is a part of a control panel of the numerical controller.

2. The keyboard according to claim 1, wherein the lower internal surface of each of the opening portions is an elliptic arc shape.

3. The keyboard according to claim 1, wherein the keyboard is mounted on the numerical controller for controlling the machine tool, and the numerical controller is subjected to airborne dust around the keyboard, and a mist of oil and dirt on a hand of an operator.

4. The keyboard according to claim 1, further comprising:

a first space defined by an upper internal surface of one of the opening portions of the housing and an upper internal surface of a respective key top among the key tops; and a second space defined by the lower internal surface of said one of the opening portions of the housing and a lower internal surface of the respective key top.

5. The keyboard according to claim 4, wherein the upper internal surface of said one of the opening portions of the housing extends in parallel with the upper internal surface of the respective key top, and the lower internal surface of said one of the opening portions of the housing is inclined with respect to the lower internal surface of the respective key top.

* * * * *